US005470294A

United States Patent [19]

Ingram

[11] Patent Number: 5,470,294

[45] Date of Patent: Nov. 28, 1995

[54] BABY WALKAROUND

[75] Inventor: Steven E. Ingram, Houma, La.

[73] Assignee: T&M Toys, Inc., Houma, La.

[21] Appl. No.: 304,290

[22] Filed: Sep. 12, 1994

[51] Int. Cl.[6] ..... A63B 3/00

[52] U.S. Cl. ..... 482/66; 482/89

[58] Field of Search ..... 482/33, 34, 37, 482/39, 66, 67, 68, 69, 89, 87, 904, 83; 135/67; 434/255, 242; 297/5

[56] References Cited

U.S. PATENT DOCUMENTS

| | | | |
|---|---|---|---|
| 341,167 | 5/1886 | Pudder | 482/66 |
| 903,731 | 11/1908 | Kull | 482/67 |
| 1,297,800 | 3/1919 | Cranford | 482/66 |
| 4,953,852 | 9/1990 | Donohue | 482/87 |
| 4,998,731 | 3/1991 | Bowen | 482/41 |

*Primary Examiner*—Stephen R. Crow
*Attorney, Agent, or Firm*—Joseph N. Breaux

[57] ABSTRACT

A baby exercise device comprising an elongated pole section including first and second pole members slidably connected to one another and securable in a fixed position by tightening a thumb screw device connected between the first and second pole members; and a butterfly bar, rotatably mounted on the pole section in a manner such that a lower section of the bar is positioned about eight inches above the floor. Each pole member includes a suction cup connector mounted at a distal end thereof in a manner to allow the sole section to be mounted between the floor and ceiling of a structure with one suction cup in contact with the ceiling and one suction cup in contact with the floor.

8 Claims, 2 Drawing Sheets

BABY WALKAROUND

BACKGROUND OF THE INVENTION

1. Technical Field

The present invention relates to infant and baby exercise equipment and, more particularly, to infant and baby exercise equipment that includes a pole having a grasping bar rotatably mounted thereon.

2. Summary of the Invention

A baby exercise device is provided. The exercise device comprises an elongated pole section including first and second pole members slidably connected to one another and securable in a fixed position by tightening a thumb screw device connected between the first and second pole members. Each pole member includes a suction cup connector mounted at a distal end thereof in a manner to allow the pole section to be mounted between the floor and ceiling of a structure with one suction cup in contact with the ceiling and one suction cup in contact with the floor. The exercise device also comprises a butterfly bar, rotatably mounted on the pole section in a manner such that a lower section of the bar is positioned about eight inches above the floor. The term "butterfly bar" is used herein to refer to a structure having an even number of sides that in conjunction with the pole section forms a polygonal shaped structure having an odd number of sides.

DESCRIPTION OF THE PREFERRED EMBODIMENTS

Figure 1:
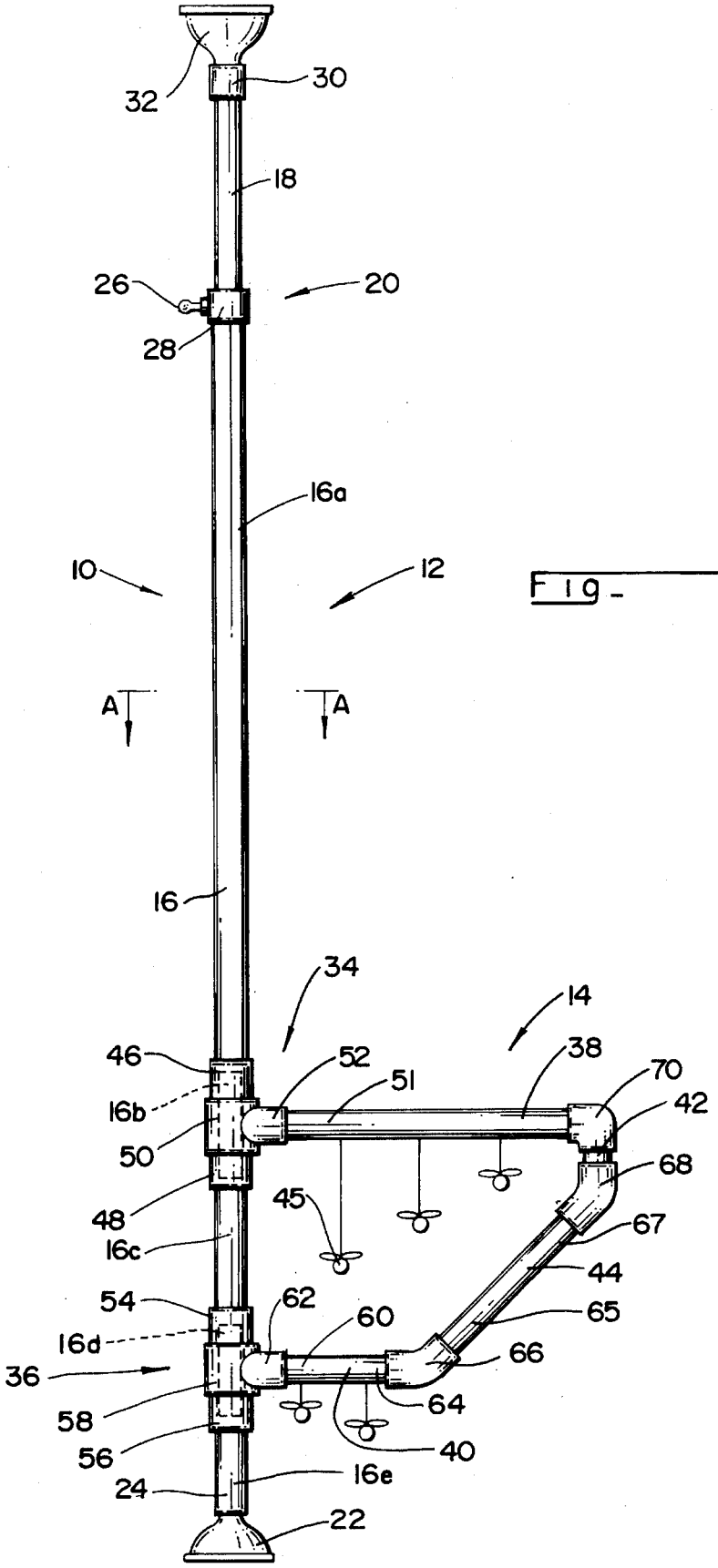
FIG. 1 is a side view of an exemplary embodiment of the exercise device of the present invention.

FIG. 1 shows an exemplary embodiment of the exercise device of the present invention generally referenced by the numeral 10. Exercise device 10 includes a main pole assembly, generally referenced by the numeral 12, and a butterfly bar assembly, generally referenced by the numeral 14.

Pole assembly 12 includes a first pole member 16, a second pole member 18, and a thumbscrew locking mechanism, generally referenced by the numeral 20. First pole 16 is about 65 inches in length and includes a first suction cup 22 attached at one end 24 and an adjustable thumbscrew 26 threaded through an aperture (not shown) at the other end 28. First pole 16 is includes five sections 16*a*, 16*b*, 16*c*, 16*d*, 16*e* of 2" PVC pipe connected with four straight PVC couplers 46,48,54,56.

Second pole member 18 is about a 48 inch length of 1½" PVC pipe that has one end (not shown) slidably disposed within end 28 of first mole member 16, and a second end 30 having a second suction cup 32 secured thereto. The distance between first suction cup 22 and second suction cup 32 is adjustable by loosening thumbscrew 26 until second pole member 18 slides within first pole member 16. Once second pole member is at a desired position, thumbscrew 26 may be tightened to secure second pole member 18.

Butterfly bar assembly 14 includes a first rotation coupling, generally referenced by the numeral 34; a second rotation coupling, generally referenced by the numeral 36; a first horizontal cantilever bar 38; a second cantilever bar 40; a first perpendicular bar 42; a diagonal bar 44, and five butterfly sculptures 45. Three of the five butterfly sculptures 45 are attached to first cantilever bar 38 with flexible strands. The other two butterfly sculptures 45 are attached to second cantilever bar 40 with flexible strands.

First rotational coupling 34 includes two of the straight line couplers 46,48 and a first T-shaped coupling member 50. First T-shaped coupling member 50 is a 2½" to 1½" PVC TEE coupling. First rotational coupling 34 is assembled by passing section 16*b* through the 2½" section of T-shaped coupling member 50 and then securing straight line couplers 46,48 to the ends of section 16*b* (shown with hidden lines in the figure). Section 16*b* is of a sufficient length to allow first T-shaped coupling member 50 to freely rotate about section 16*b*. One end 51 of first cantilever bar 38 is secured to a leg 52 of first T-shaped coupling member 50.

Second rotational coupling 36 includes the other two of the straight line couplers 54,56 and a second T-shaped coupling member 58. Second T-shaped coupling member 58 is a 2½" to 1½" PVC TEE coupling. Second rotational coupling 36 is assembled by passing section 16*d* through the 2½" section of T-shaped coupling member 58 and then securing straight line couplers 54,56 to the ends of section 16*d* (shown with hidden lines in the figure). Section 16*d* is of a sufficient length to allow second T-shaped coupling member 58 to freely rotate about section 16*d*. One end 60 of second cantilever bar 40 is secured to a leg 62 of second T-shaped coupling member 58. Construction of butterfly bar assembly 14 is completed by attaching a second end 64 of second cantilever bar 40 to an end 65 of diagonal bar 44 using a first forty-five degree elbow connector 66, attaching a second end 67 of diagonal bar 44 to first perpendicular bar 42 using a second forty-five degree elbow connector 68, and attaching the other end of perpendicular bar 42 to first cantilever bar 38 with a ninety degree elbow 70.

Figure 2:
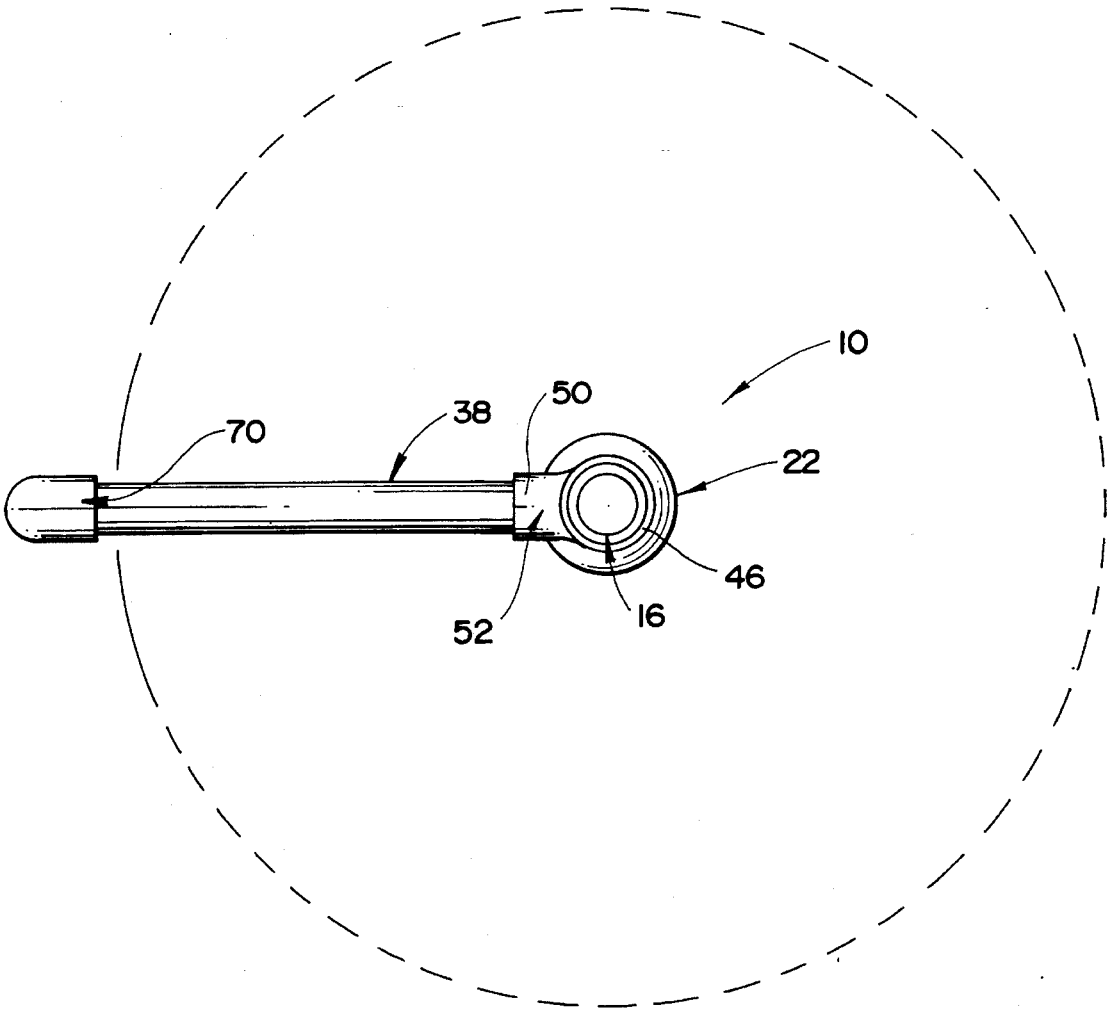
FIG. 2 is a cross-sectional view of the embodiment shown in FIG. 1 along the line A—A.

FIG. 2 is a cross-sectional top view of exercise device 10 along the line A—A of FIG. 1. The figure shows first pole 16, straight line coupler 46, leg 52 of first T-shaped coupling member 50, first cantilever bar 38, ninety degree elbow 70, and first suction cup connector 22. As shown in the figure, butterfly bar assembly 14 is rotatable 360 degrees in both the clockwise and counter-clockwise direction about first pole 16.

Use of the device is described with general reference to FIGS. 1 and 2. Pole assembly 12 is secured between the floor and ceiling of a room by loosening thumbscrew 26 until second pole member 18 is slidable within end 28 of first pole member 16, forcing pole member 18 upward until suction cup 32 contacts and is depressed against the ceiling, and then tightening thumbscrew 26 until second pole member 18 is secured within first pole member 16. Once pole assembly 12 is secured between the floor and selling of a room, a child may be allowed to investigate and play with the butterfly bar assembly 14. When the child grasps second cantilever bar 40, diagonal bar 44 may be used by the child to gradually lift himself into a standing position. Because the butterfly bar assembly freely rotates in the clockwise and counter clockwise directions the child is allowed to walk about pole assembly 16 in either direction by taking forward or reward steps.

It is noted that the embodiment of the baby exercise device described herein in detail for exemplary purposes is of course subject to many different variations in structure, design, application and methodology. Because many varying and different embodiments may be made within the scope of the inventive concept (s) herein taught, and because many modifications may be made in the embodiment herein detailed in accordance with the descriptive requirements of the law, it is to be understood that the details herein are to be interpreted as illustrative and not in a limiting sense.

What is claimed is:

1. A baby exercise device comprising:

an adjustable length pole assembly having a lower pole section, an upper pole section and a locking mechanism for selectively locking said first and second pole section in a fixed relationship with one another; and a revolving bar assembly rotatably connected to said lower pole section by a first and second coupling assembly, said first coupling assembly having extending therefrom a first elongated horizontal member, said second coupling assembly having extending therefrom a second elongated horizontal member, said first and second horizontal members being oriented substantially in parallel and interconnected by a connecting assembly having a first portion extending diagonally to said first and second horizontal members and a second portion extending substantially perpendicular to said first and second horizontal members.

2. The baby exercise device of claim 1 wherein:

said locking mechanism includes a set screw mechanism threaded through an aperture formed through said first pole section; and said second pole section is securable in a plurality of positions by rotating said set screw in a first predetermined direction.

3. The baby exercise device of claim 2 wherein:

said adjustable length pole assembly includes first and second contact means disposed on opposes ends thereof for contacting and forming a connection with a section of a ceiling and a section of a floor of a room.

4. The baby exercise device of claim 3 wherein:

said first and second contact means are suction cups.

5. The baby exercise device of claim 3 wherein:

said first elongated horizontal member is of a length two and one-half times the length of second elongated horizontal member.

6. The baby exercise device of claim 5 wherein:

said first and second horizontal members are both located within thirty inches of an end of said lower pole section.

7. The baby exercise device of claim 6 wherein:

said first portion of said connecting assembly that extends diagonally to said first and second horizontal members is oriented at a substantially forty-five degree angle to one of said first and second horizontal bars.

8. The baby exercise device of claim 7 further including:

a plurality of ornamental sculptures attached to said revolving bar assembly with a flexible strand.

* * * * *